US007108635B2

(12) United States Patent
Howlett-Campanella

(10) Patent No.: US 7,108,635 B2
(45) Date of Patent: Sep. 19, 2006

(54) YOGA MAT WITH BODY CONTACT PLACEMENT INDICIA

(76) Inventor: Helen Hardman Howlett-Campanella, 29500 Heathercliff Road, #130, Malibu, CA (US) 90265

( * ) Notice: Subject to any disclaimer, the term of this patent is extended or adjusted under 35 U.S.C. 154(b) by 758 days.

(21) Appl. No.: 09/765,533

(22) Filed: Jan. 19, 2001

(65) Prior Publication Data

US 2001/0034288 A1 Oct. 25, 2001

Related U.S. Application Data

(60) Provisional application No. 60/229,868, filed on Aug. 30, 2000, provisional application No. 60/177,512, filed on Jan. 21, 2000.

(51) Int. Cl.
*A63B 26/00* (2006.01)

(52) U.S. Cl. ..... 482/23; 482/907; D21/797

(58) Field of Classification Search ..... 482/23–28, 482/91, 140, 907, 34–41; 33/562–563, 565, 33/494, 31, 1 B; D6/596; D21/191, 797–798; 428/88, 96

See application file for complete search history.

(56) References Cited

U.S. PATENT DOCUMENTS 4,009,880 A * 3/1977 Lammersen ..... 273/1 A
4,985,952 A * 1/1991 Edelson ..... 5/465
5,645,494 A * 7/1997 Dionne et al. ..... 473/278

* cited by examiner

*Primary Examiner*—Lori Amerson
(74) *Attorney, Agent, or Firm*—Kelly Lowry & Kelley, LLP

(57) ABSTRACT

A yoga mat is provided having a symmetrical body placement guide on an upper surface of the mat. The body placement guide is configured to aid a yoga practitioner to properly align the practitioner's body during yoga postures. The body placement guide includes a patterned design defining a longitudinal axis substantially extending the length of and bisecting the upper surface of the mat. The patterned design also defines a transverse axis bisecting the longitudinal axis. The longitudinal axis and transverse axis define four equal quadrants. Each quadrant is adjacent to other quadrants, the pattern design in each quadrant being a mirror image of the pattern design of the two adjoining quadrants. The pattern design also includes step indicia within each quadrant.

15 Claims, 4 Drawing Sheets

YOGA MAT WITH BODY CONTACT PLACEMENT INDICIA

RELATED APPLICATION

This application claims priority from provisional application Ser. No. 60/177,512, filed Jan. 21, 2000; and provisional application Ser. No. 60/229,868, filed Aug. 30, 2000.

BACKGROUND OF THE INVENTION

The present invention relates generally to a mat on which yoga is practiced. More particularly, the present invention relates to a yoga mat which includes a design on the yoga mat that helps the yoga practitioner to properly align the body during postures.

There are many kinds of yoga, as well as many reasons to practice yoga. In particular, yoga mats are preferably used in Hatha Yoga, which deals with keeping the physical body fit. The focus is on balance, strength, flexibility, and coordination on both sides of the body. Generally, people have a dominant side, for example, in golf, tennis and baseball people swing only one way as they are either right or left-handed. Only a few people are capable of swinging both right and left. It is not uncommon for chiropractors and yoga instructors to find that one leg of a client might be a little longer than the other due to injuries, poor posture or lack of exercise. It is possible that a leg might be from ¼" to one full inch off from the other leg. This adversely affects our health as one knee might not bend as well as the other and the effect is magnified through the rest of the body. The purpose of Hatha Yoga practice is to make the right and left sides of our bodies equally strong, flexible and balanced to the best of our ability.

A fundamental part of yoga, in its simplest form, is moving the body in the seven possible one-movement directions and in varying combinations of those movements. For example, the body (1) forward bends, (2) backward bends, (3&4) twists right and left, (5&6) bend from side to side right and left, and (7) extends, stretching from head to toe. An exemplary combination is a twisting forward bend. Another important dimension or aspect of Hatha Yoga is that the postures are either symmetrical (both sides of the body doing the same thing, example: sitting with both legs in forward bend) or asymmetrical (for example, sitting in forward bend with one leg bent into the thigh of the straight leg). In a Hatha Yoga practice session, the bodies are moved in as many different directions and in different combinations as equally and to the best of the practitioner's ability as possible.

Yoga postures are based and taught that the postures are built from the foundation up, analogous to the building of a house. The definition of "foundation" for this purpose is the part of the body touching the floor. There are basically two kinds of foundations: 1) down on the floor, for example, prone, supine or sitting; and 2) up off the floor, for example standing, kneeling on hands and feet, hands and knees, headstand, elbow stand, handstand. There are over one thousand yoga postures. Standing balancing poses need a good foundation so that the practitioner doesn't fall down. A short flexible person's feet would be wider apart in his or her stance than a practitioner who is less flexible and a tall person's feet would be even wider apart in his or her stance.

Yoga poses are held for a good length of time, sometimes one minute or more. Being stable is important and again the foundation is a good start. Like a gymnast on a balance beam, alignment brings stability, example: standing with the legs wide apart in forward bend over right leg, the back leg needs to be in line with the right leg not crossed midline (off the balance beam). Exact placement of the feet changes from teacher to teacher and pose to pose depending on purpose and ability.

Before the development of the present invention, a practitioner was taught to use the horizontal and vertical lines in the room as a guide to position not only the mat but the body as well. There might be visual aids such as lines within a hardwood floor, or the lines where the walls and floor come together. The mats are put on the floor as straight as possible with respect to the room and all facing in the same direction.

There currently does not exist a yoga mat which charts the progress of the student. Nor does there exist a yoga mat which indicates the proper alignment of a number of variations of postures.

Accordingly, there is a need for a universally usable yoga mat which aids the yoga practitioner in properly aligning himself or herself in various poses and which allows the practitioner to determine his or her flexibility progress. The present invention fulfills these needs and provides other related advantages.

SUMMARY OF THE INVENTION

The present invention resides in a yoga mat which allows a practitioner to properly align his or her body in a variety of poses as well as tracking his or her flexibility progress. The yoga mat generally comprises an elongated mat having an upper and a lower surface. In a particularly preferred embodiment of the invention, the elongated mat has a rectangular configuration. A symmetrical body placement guide is imprinted on the upper surface of the mat and configured to aid the yoga practitioner to properly align the practitioner's body during yoga postures. The body placement guide includes a patterned design defining a longitudinal axis which substantially extends the length and bisects the upper surface of the mat. The pattern design also defines a transverse axis bisecting the longitudinal axis. The longitudinal axis and transverse axis define four equal quadrants. Each quadrant is adjacent to two other quadrants. The pattern design in each quadrant is a mirror image of the pattern design of the two adjoining quadrants.

The pattern design typically includes indicia positioned from either the longitudinal or transverse axis at a forty-five degree angle. This indicia preferably comprises a line extending from either the longitudinal axis or transverse axis at the forty-five degree angle.

The patterned design may define multiple segments of equal area that are parallel to the transverse axis. The pattern design may also define multiple segments of equal area parallel to the longitudinal axis.

The patterned design includes step indicia within each quadrant. The step indicia may be created by intersecting lines that form a ninety degree angle.

Other features and advantages of the present invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 3:
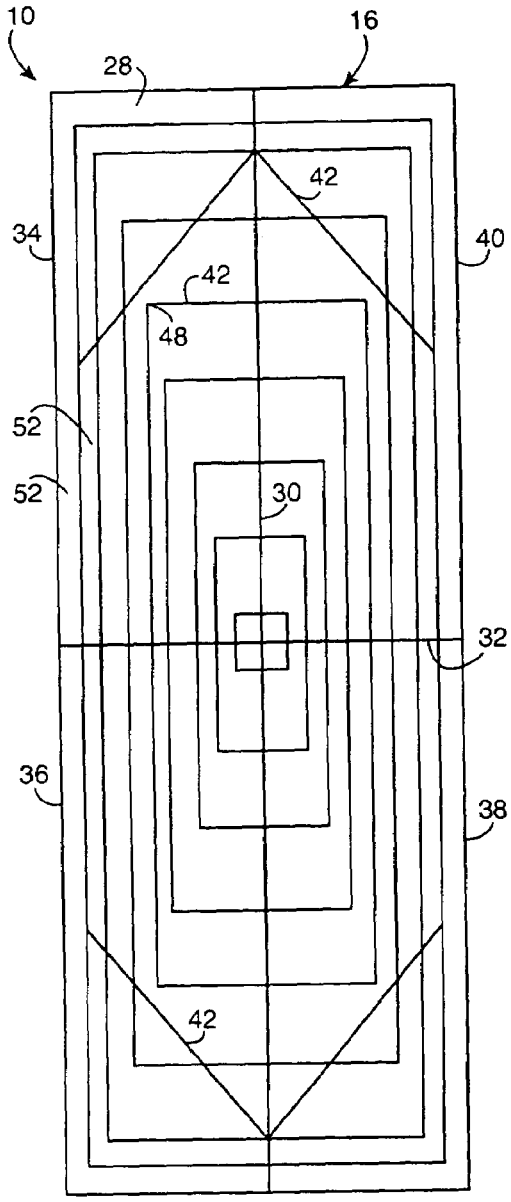
Figure 4:
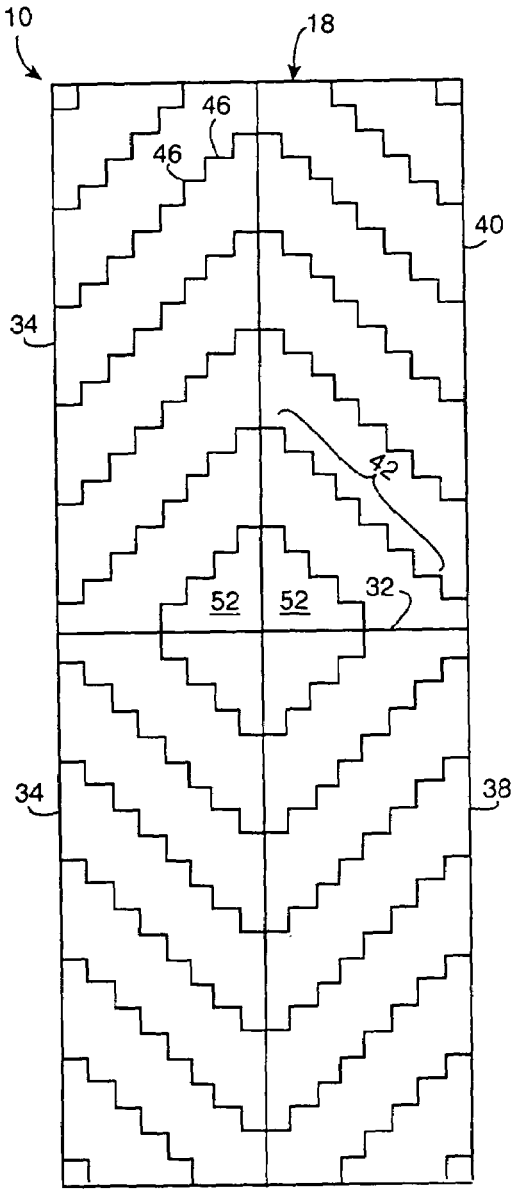
Figure 5:
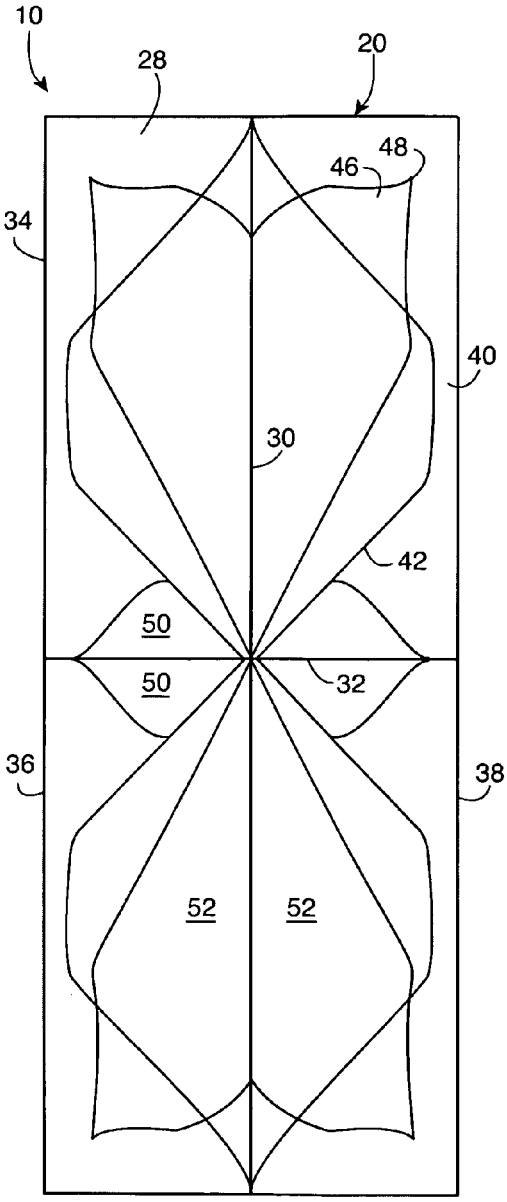

As shown in the drawings for purposes of illustration, the present invention is concerned with a yoga mat, referred to generally in the drawings by the reference number 10, having a body placement guide design (referred to in FIG. 1 by the reference number 12, in FIG. 2 by the reference number 14, in FIG. 3 by the reference number 16, and FIG. 4 by the reference number 18, in FIG. 5 by the reference number 20, in FIG. 6 by the reference number 22, in FIG. 7 by the reference number 24, and in FIG. 8 by the reference number 26) on a top surface 28 of the mat 10 to facilitate proper placement of the body parts, alignment, improvement and fine tuning in yoga postures. In the several illustrated embodiments, the same reference numbers will be used for similar features common in the embodiments throughout the description.

Although the mats 10 themselves can be of a variety of shapes and sizes, they are preferably rectangular in shape. Typically, a rectangular yoga mat 10 will have dimensions of approximately 24" in width and 68" in length.

The body placement guide designs 12–26 help guide the practitioner's body in posture so that both sides of the body stretch equally with alignment and balance. Before the present invention, such postures and alignment was a guessing estimate. Working with the placement guide designs 12–26, the practitioner can see where he or she should place the body parts.

The body placement guide designs 12–26 are illustrated for exemplary purposes only and it is to be understood that other designs can be created using the concepts taught by the invention while still providing the benefits thereof. The body placement guide designs 12–26 need to be generic because yoga practitioners are of different height, flexibility and yoga ability. The yoga poses are also very different, in that sometimes the feet are together, a few inches apart, or several feet apart. The body placement guide designs 12–26 according to the following description accommodate all body types and all postures depending on purpose and ability.

Figure 1:
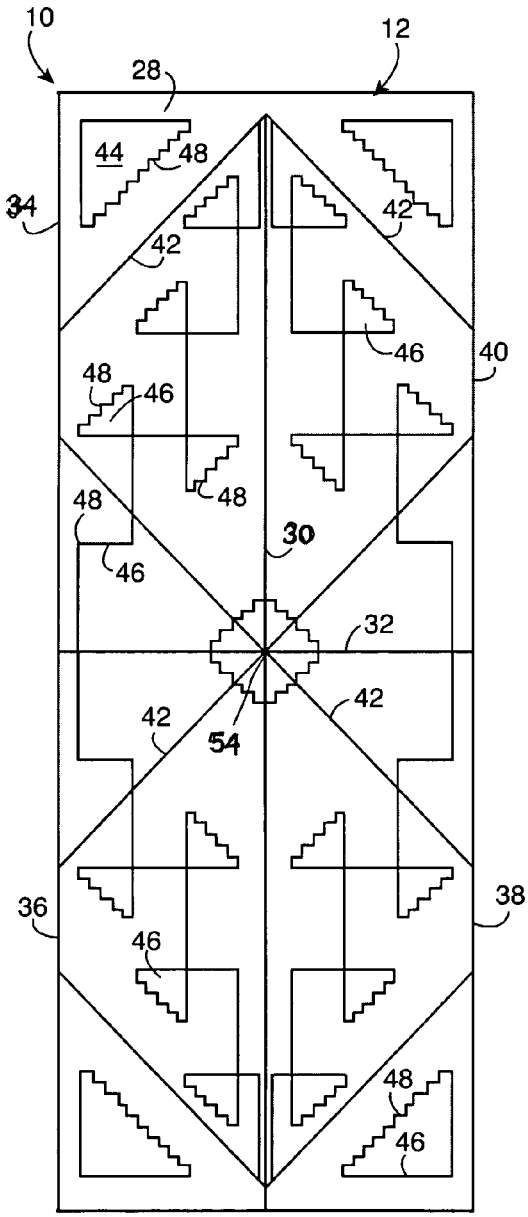
FIGS. 1–8 are all top plan views of body placement guide designs embodying the present invention.
Figure 6:
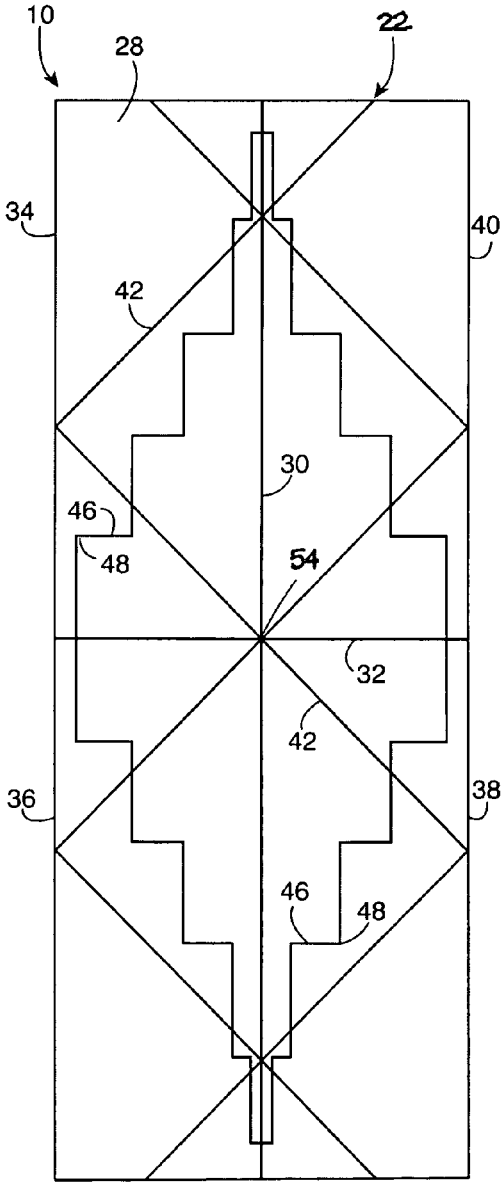
Figure 7:
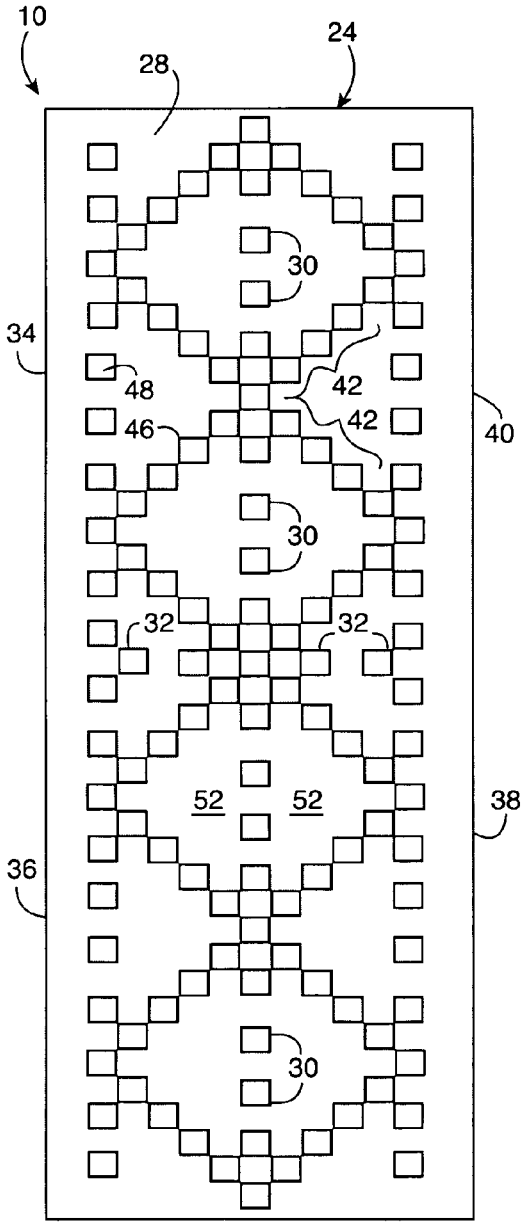
Figure 8:
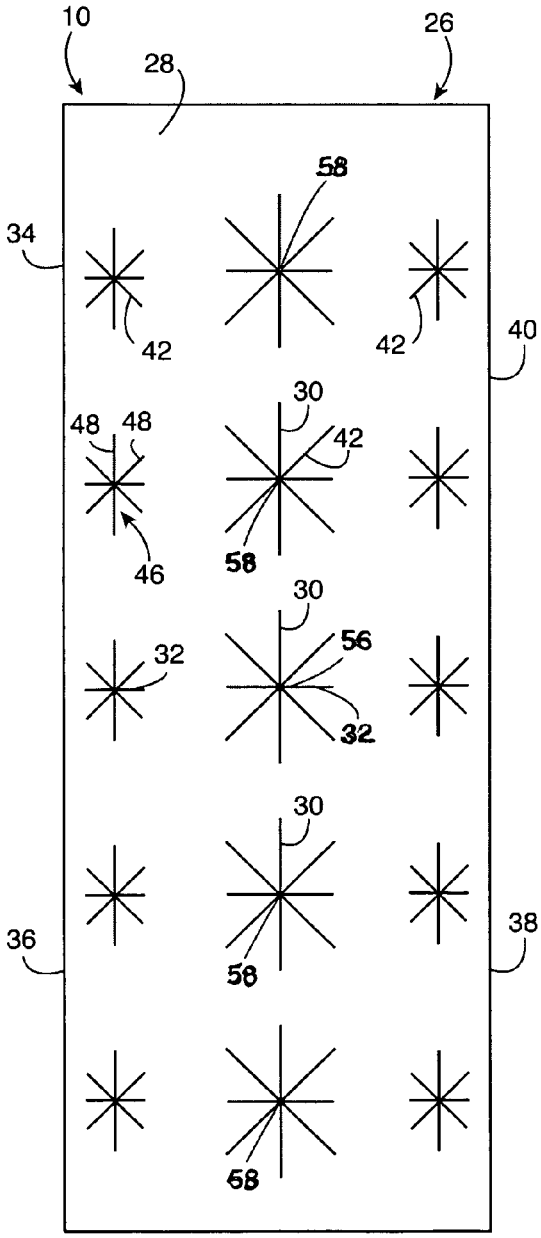

Referring now to FIG. 1, a body placement guide design 12 is illustrated on a top surface 28 of a yoga mat 10. In all of the embodiments of the present invention, the patterned design defines a longitudinal axis 30 that extends substantially the length of the upper surface 28 so as to bisect the upper surface 28 into two equal halves. The pattern design 12 also defines a transverse axis 32 which bisects the longitudinal axis 30, to create equal top and bottom halves of the design. As illustrated in FIGS. 1–6, the longitudinal axis 30 is defined by a line extending the length of the design 12–22. However, as illustrated in FIGS. 7 and 8, the pattern design 24 and 26 may merely align indicia to create the longitudinal and transverse axes 30 and 32.

The longitudinal and transverse axes 30 and 32 define four equal quadrants 34,36,38,40 . Each quadrant is adjacent to two other quadrants, for example in FIG. 1 quadrant 34 is adjacent to quadrants 36 and 40. It will be noted that the body placement guide design 12 is symmetrical throughout the design such that each half of the design, taken either by the longitudinal axis 30 or the transverse axis 32 is a mirror image of the other half. Further, the patterned design 12 in each quadrant is a mirror image of the pattern design of the two adjoining quadrants. For example, quadrant 34 is a mirror image of quadrant 36, as well as a mirror image of quadrant 40.

The pattern design 12 includes indicia 42 positioned from the longitudinal axis 30 at a forty-five degree angle. As illustrated in FIG. 1, this indicia comprises lines extending from the longitudinal axis 30 at a forty-five degree angle. However, as illustrated in FIGS. 7 and 8, the indicia may be merely aligned with the longitudinal axis 30 at a forty-five degree angle. As seen in FIGS. 1 and 6, a marker 54 may also be placed at the center point of mat 10 (which is also the center point of quadrants 24–40) where longitudinal axis 30 and transverse axis 32 intersect. Marker 54 may be circular.

Figure 2:
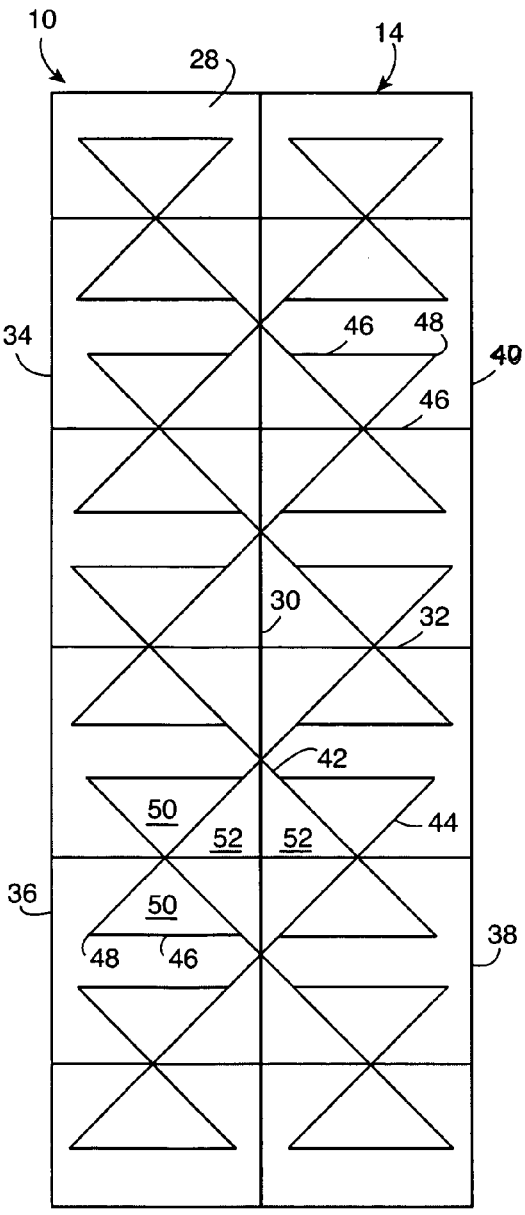

With reference to FIG. 2, other indicia 44 may be positioned from the transverse axis 32 at a forty-five degree angle. As illustrated in FIG. 2, this indicia 44 comprises a line, although the indicia may be merely positioned relative to the transverse axis 32 so as to create a forty-five degree angle therewith as illustrated in FIGS. 7 and 8.

Referring back to FIG. 1, the pattern design 12 includes step indicia 46 in each quadrant 34–40. Such step indicia 46 are equally placed in each quadrant. Preferably, the step indicia 46 divides the design 12 into a step pattern having large movement step indicia 46 and smaller movement step indicia 48, usually associated with the larger step indicia 46. Typically, the step indicia 46 and 48 are created by intersecting lines forming a ninety degree angle. The small step indicia 48 allow for fine tuning of the posture and can be used to chart flexibility as the practitioner progresses.

Referring now to FIG. 2, the pattern design 14 can define multiple segments 50 of equal area which are parallel to the transverse axis 32. Similarly, the pattern design 14 may define multiple segments 52 which are parallel to the longitudinal axis. Such segments 50 and 52 are typically created by lines that run generally parallel with either the longitudinal axis 30 or the transverse axis 32.

It will be noted that the indicia and segments 42–52 typically extend away from the center of the mat. The indicia 42–48, often in the form of parallel and vertical guidelines, incrementally help the practitioner as body parts are moved away from the center of the design 12–26. As seen in FIG. 8, a marker 56 may also be placed at the center point of mat 10 (which is also the center point of quadrants 34–40). Marker 56 may be circular. Additional markers 58 may also be placed at a plurality of points where indicia (e.g., line 42) intersect longitudinal axis 30 and/or transverse axis 32. Markers 58 may be circular. As a whole, the design 12–26 is intended to be pleasing to the eye and fill the space of the mat 10 to facilitate body alignment with the more or less one thousand postures that the practitioner can perform. Once the practitioner understands the most common and used positions and how they relate to the mat design 12–26, other positions can be applied to the design using common sense.

Several examples will now be given of how the body placement guide designs 12–26 can be used in practice. Particular reference will be given to the design 12 of FIG. 1, although it will be understood that the examples described herein can be applied to the other designs 14–26 as well.

The longitudinal and transverse axis 30 and 32 divide the mat 10 in half length-wise and width-wise to center the mat 10 and guide the body as it moves away forward, back and out to the sides from the center of the mat 10. For example, while on the hands and knees, the knees can be widened along the longitudinal axis 30 with the hips over the center of the map and the knees out to the side as they are increasingly brought lower to the floor. It is easy for one knee to come forward or backward off the longitudinal axis 30, which would work unevenly through the hips, inner thighs and low back. Thus, the practitioner can use the patterned design 12 to ensure that the knees widen along the longitudinal axis 30.

Similarly, the knees can be widened apart along the transverse axis 32. Ideally, the feet also widen so that there is a ninety-degree angle in the ankles, a ninety-degree angle in the knees to the hips, and a ninety-degree angle from the thighs to the sides of the body. The step indicia 46 can be used to ensure that the ninety-degree angle is held in the ankles, knees and hips.

The longitudinal axis 30 is particularly helpful in triangle poses (standing poses with the legs wide apart). The practitioner places the forward foot on the longitudinal axis so as to bisect the big toe and little toe of the foot. The back foot is then placed on the longitudinal axis also, but turned out at a forty-five degree angle to bisect the toes from the heel. Indicia 42 can help the practitioner to position the back foot at the forty-five degree angle. In triangle poses, the "foundation" feet change little as the variations change in the upper body, with either both legs straight, one leg straight and the other knee bent at the knee, etc. Triangle poses are also asymmetrical so the pose would typically be done first with the right leg forward, and then the left leg forward.

Another example using the longitudinal axis 30 is to sit in the center with both legs extending forward. The longitudinal axis 30 is used as a guide so that the right heel is in line with the right hip and the left heel in line with the left hip. Without such visual direction, many times one leg drifts one way or the other and out of alignment. With the longitudinal axis 30 defined by the design 12, the practitioner can easily determine that both legs and heels are equally spaced from the longitudinal axis 30.

In one particular posture, the left foot is brought into the straight right leg thigh. The indicia 42 positioned at forty-five degree alignment from the longitudinal axis 30 allows the practitioner to ensure that the left leg is at a forty-five degree angle to the right leg. Not only do the forty-five degree angle indicia 42 and 44 provide alignment guidance, but they also can serve to define the step indicia 46 so that the body parts can be placed on, past, before and in the middle of postures that take the body parts away from either the longitudinal axis 30 or transverse axis 32. An exemplary posture which utilizes the step indicia 46 and 48 begins when the practitioner is on all four hands and knees, or feet hands and feet. The practitioner starts on his or her hands and knees with the hand directly underneath the shoulders. The large step indicia 46 is used so that both hands point forward in the same direction and equally apart. The knees are under the hips equally apart and equally in line using the large step indicia 46 as the knees are placed equally before, on or past the large step indicia 46. As it is very easy to be off by a fraction of an inch, the practitioner can use the small step indicia 48 for fine tuning.

The pattern designs 12–26 provide enough indicia to accommodate all body types and ability. As the hands or feet can be placed on, past or before the indicia 42–48, or lines, any given practitioner can properly position his or her body for any given posture. Also, the practitioner can chart his or her increased flexibility and yoga ability.

For a yoga teacher, the benefits of the designs 12–26 are obvious. However, the implications of the designs 12–26 may not be as obvious to a beginning practitioner. But as the beginning practitioner learns skills and various postures, he or she is able to track subtle movements and improvements visually using the designs 12–26.

Although several embodiments have been described in detail for purposes of illustration, various modifications may be made without departing from the scope and spirit of the invention. Accordingly, the invention is not to be limited, except as by the appended claims.

What is claimed is:

1. A yoga mat, comprising:

an elongated mat having an upper surface and a lower surface; and a symmetrical body placement guide on the upper surface of the mat and configured to aid a yoga practitioner to properly align the practitioner's body during yoga postures, the body placement guide including:

a patterned design defining a longitudinal axis substantially extending the length of and bisecting the upper surface, the patterned design further defining a transverse axis bisecting the longitudinal axis, and indicia positioned from the longitudinal axis at a forty-five degree angle comprises a line extending from the longitudinal axis at a forty-five degree angle; and four equal quadrants defined by the longitudinal axis and the transverse axis, each quadrant being adjacent to two other quadrants, the patterned design in each quadrant being a mirror image of the patterned design of the two adjoining quadrants.

2. The yoga mat of claim 1, wherein the patterned design includes indicia positioned from the transverse axis at a forty-five degree angle comprising a line extending from the transverse axis at a forty-five degree angle, perpendicular to the line extending from the longitudinal axis at a forty-five decree angle.

3. The yoga mat of claim 1, wherein the patterned design defines multiple segments of equal area parallel to the transverse axis.

4. The yoga mat of claim 1, wherein the patterned design defines multiple segments of equal area parallel to the longitudinal axis.

5. The yoga mat of claim 1, wherein the patterned design includes step indicia within each quadrant.

6. The yoga mat of claim 5, wherein the step indicia are created by intersecting lines forming a ninety degree angle.

7. A yoga mat, comprising:

an elongated mat having an upper surface and a lower surface; and a symmetrical body placement guide on the upper surface of the mat and configured to aid a yoga practitioner to properly align the practitioner's body during yoga postures, the body placement guide including:

a patterned design defining a longitudinal axis substantially extending the length of and bisecting the upper surface, the patterned design further defining a transverse axis bisecting the longitudinal axis; and four equal quadrants defined by the longitudinal axis and the transverse axis, each quadrant being adjacent to two other quadrants, the patterned design in each quadrant being a mirror image of the patterned design of the two adjoining quadrants;

wherein the patterned design includes indicia positioned from the longitudinal axis at a forty-five degree angle comprising a line extending from the longitudinal axis at a forty-five decree angle; and wherein the patterned design includes indicia positioned from the transverse axis at a forty-five degree angle comprising a line extending from the transverse axis at a forty-five degree angle, perpendicular to the line extending from the longitudinal axis at a forty-five degree angle.

8. The yoga mat of claim 7, wherein the patterned design defines multiple segments of equal area parallel to the transverse axis.

9. The yoga mat of claim 7, wherein the patterned design defines multiple segments of equal area parallel to the longitudinal axis.

10. The yoga mat of claim 7, wherein the patterned design includes step indicia within each quadrant.

11. The yoga mat of claim 10, wherein the step indicia are created by intersecting lines forming a ninety degree angle.

12. A yoga mat, comprising:

an elongated mat having a rectangular configuration, an upper surface and a lower surface; and a symmetrical body placement guide on the upper surface of the mat and configured to aid a yoga practitioner to properly align the practitioner's body during yoga postures, the body placement guide including:

a patterned design defining a longitudinal axis substantially extending the length of and bisecting the upper surface, the patterned design further defining a transverse axis bisecting the longitudinal axis; and four equal quadrants defined by the longitudinal axis and the transverse axis, each quadrant being adjacent to two other quadrants, the patterned design in each quadrant being a mirror image of the patterned design of the two adjoining quadrants;

wherein the patterned design includes indicia positioned from the longitudinal axis at a forty-five degree angle comprising a line extending from the longitudinal axis at a forty-five degree angle;

wherein the patterned design includes indicia positioned from the transverse axis at a forty-five degree angle comprising a line extending from the transverse axis at a forty-five degree angle, perpendicular to the line extending from the longitudinal axis at a forty-five degree angle; and wherein the patterned design includes step indicia within each quadrant.

13. The yoga mat of claim 12, wherein the patterned design defines multiple segments of equal area parallel to the transverse axis.

14. The yoga mat of claim 12, wherein the patterned design defines multiple segments of equal area parallel to the longitudinal axis.

15. The yoga mat of claim 12, wherein the step indicia are created by intersecting lines forming a ninety degree angle.

* * * * *